United States Patent [19]

Daeyaert

[11] Patent Number: 4,993,923

[45] Date of Patent: Feb. 19, 1991

[54] ROTARY COMPRESSOR WITH CAPACITY REGULATION VALVE

[75] Inventor: Guido J. E. Daeyaert, Mortsel, Belgium

[73] Assignee: Atlas Copco Aktiebolag, Stockholm, Sweden

[21] Appl. No.: 143,353

[22] Filed: Jan. 12, 1988

[30] Foreign Application Priority Data

Jan. 20, 1987 [SE] Sweden ..... 8700199

[51] Int. Cl.[5] ..... F04C 29/08

[52] U.S. Cl. ..... 417/283; 417/310; 418/201.2

[58] Field of Search ..... 418/14, 104, 201 A, 418/132, 135; 417/310, 299, 283

[56] References Cited

U.S. PATENT DOCUMENTS

| | | | |
|---|---|---|---|
| 2,205,919 | 6/1940 | Brouse | 418/14 |
| 2,437,791 | 3/1948 | Roth et al. | 417/283 |
| 2,519,913 | 8/1950 | Lysholm | 418/201 A |
| 3,108,739 | 10/1963 | Nilsson et al. | 417/428 |
| 3,160,072 | 12/1964 | Martin | 418/14 |
| 3,175,468 | 3/1965 | Miller | 418/14 |
| 3,527,548 | 9/1970 | Kocher et al. | 417/310 |
| 4,253,803 | 3/1981 | Wormmeester et al. | 417/283 |
| 4,388,048 | 6/1983 | Shaw et al. | 417/299 X |
| 4,498,849 | 2/1985 | Schibbye et al. | 417/299 |
| 4,505,655 | 3/1985 | Honaga et al. | 418/135 X |
| 4,799,865 | 1/1989 | Oscarsson | 417/283 |

OTHER PUBLICATIONS

*Pump Handbook*, Karassik, Igor, et al., McGraw-Hill Book Co., New York, 1976, pp. 3-50, 3-70.

*Primary Examiner*—Leonard E. Smith

*Attorney, Agent, or Firm*—Eric Y. Munson; Mark P. Stone

[57] ABSTRACT

A rotary compressor being provided with a capacity regulation valve (16) at the outlet of the compressor. The valve is movable between a first position (18) in sealing cooperation with an end face (19) of the compressor rotor and a second position (20) creating a leakage path between the outlet opening (15) and the inlet opening (14) of the compressor.

4 Claims, 3 Drawing Sheets

ROTARY COMPRESSOR WITH CAPACITY REGULATION VALVE

The present invention relates to a rotary compressor particularly to a rotary compressor provided with a simple and efficient valve for capacity regulation of the compressor. The valve also allows unloaded start of the compressor.

According to one prior art capacity regulation of a screw compressor the inlet channel is throttled so as to allow only a part of the full capacity gas flow to be delivered by the compressor. This is a simple way of obtaining capacity regulation. However, the power required to drive the compressor at part load is rather close to the power required when the compressor runs at full capacity.

Another prior art solution provides for the returning of uncompressed gas to the inlet. This is accomplished by means of either a slide valve movable in the wall of the compression chamber or a turn valve arranged in the housing and communicating with the compression chamber. This idea provides for lower power requirement at a part load than the above mentioned prior art. However, the compressor becomes considerably more complicated.

According to a further prior art solution, U.S. Pat. No. 3,527,548, partly compressed gas is conducted back to the inlet through the rotor shaft. This solution results in a rather complicated rotor shaft which furthermore becomes less stiff so that rotor deflections increase. This results in sealing problems.

The present invention, which is defined in the appended claims, aims at creating a rotary compressor having a simple capacity regulation valve which provides for a part load power requirement which is substantially lower than the power requirement of the throttled inlet capacity regulation.

Figure 1A:
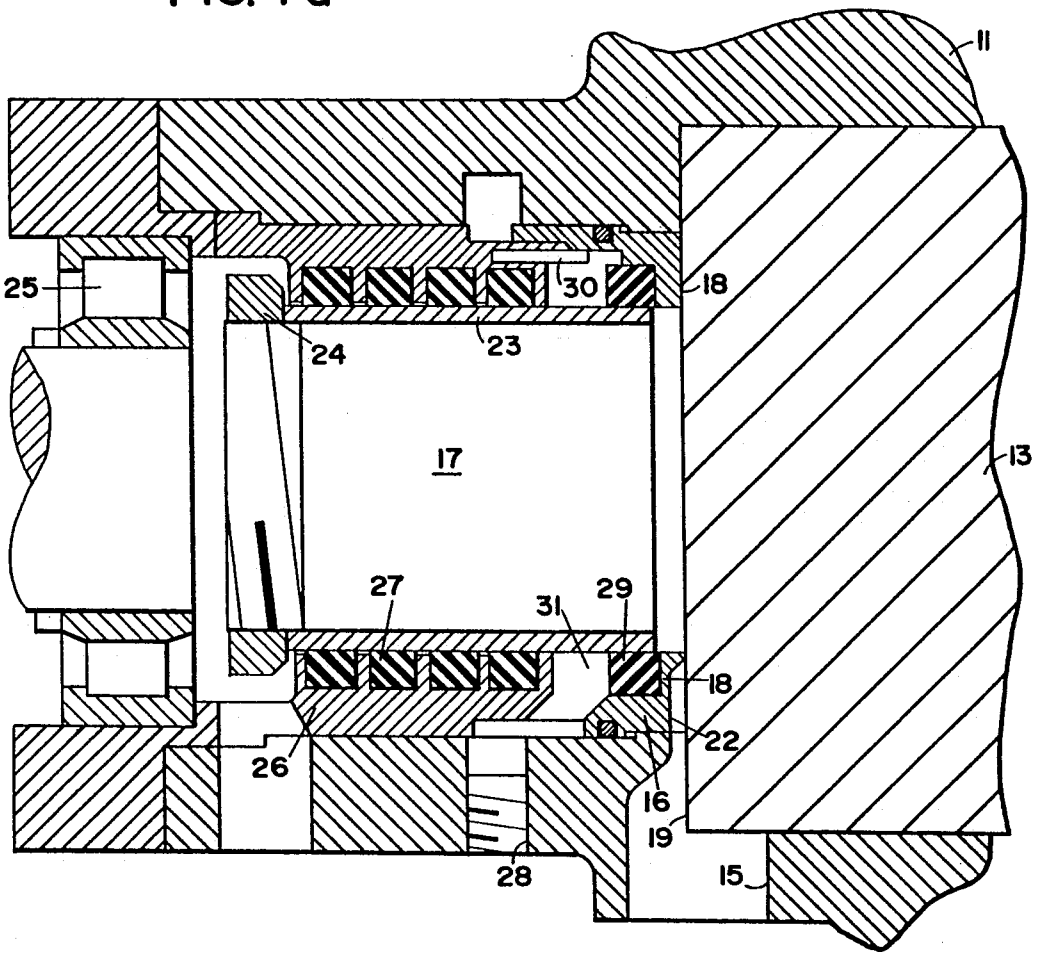
Figure 1B:
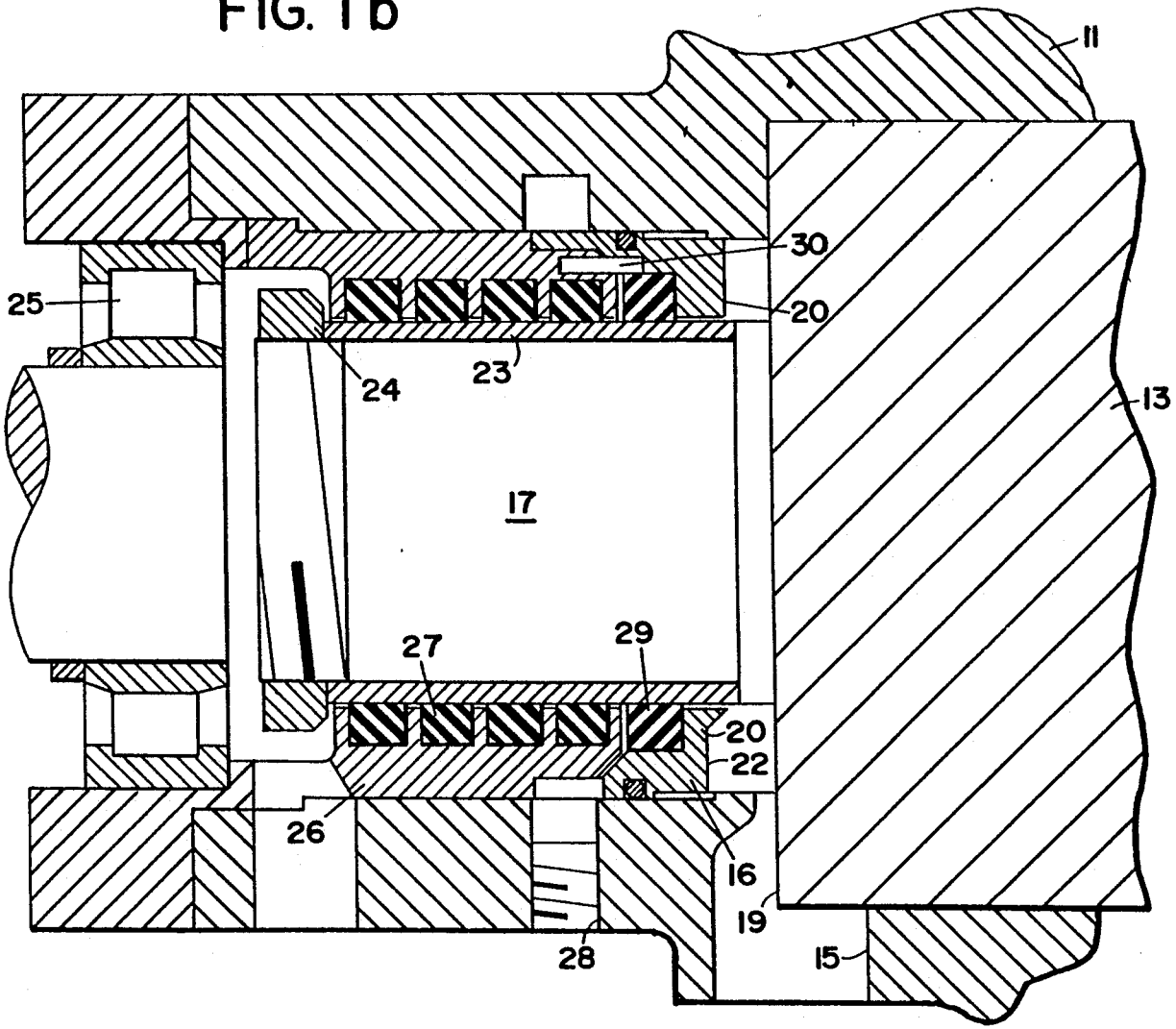

An embodiment of the invention is described below with reference to the accompanying drawings in which:

FIGS. 1*a* and 1*b* illustrate sections through one end of a screw compressor in which FIG. 1*a* shows a valve in a sealing position, while FIG. 1*b* is similar to FIG. 1*a* but shows the valve in an open position.

Figure 2:
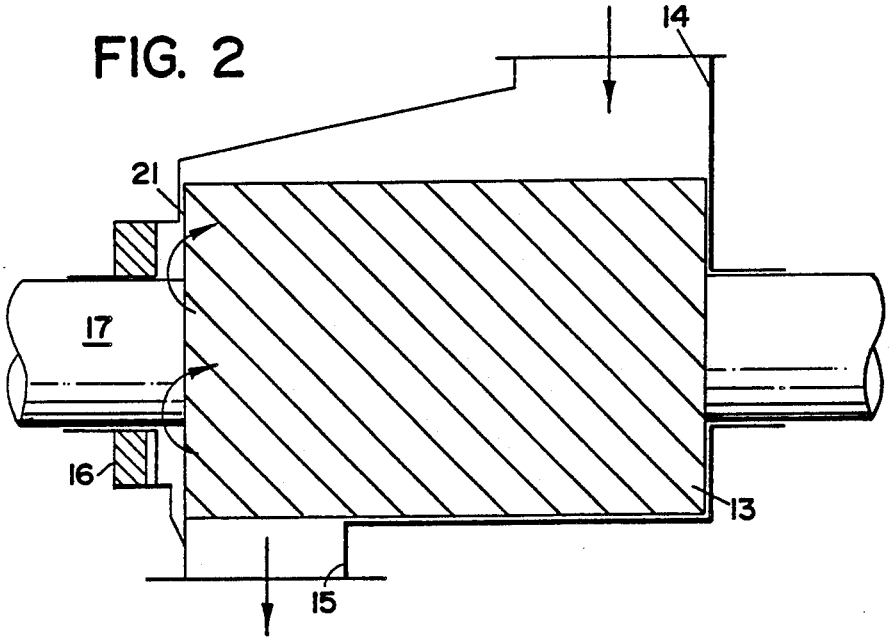
Figure 3:
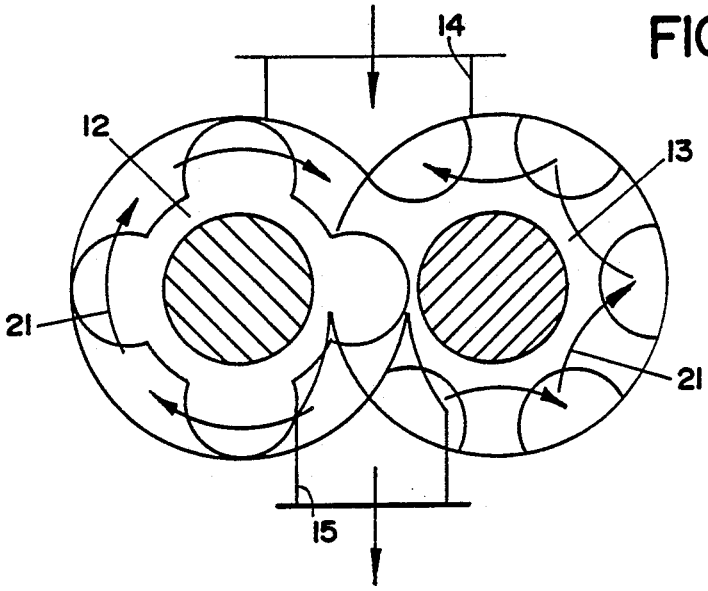

FIGS. 2 and 3 schematically show how the regulation valve operates.

Figure 4:
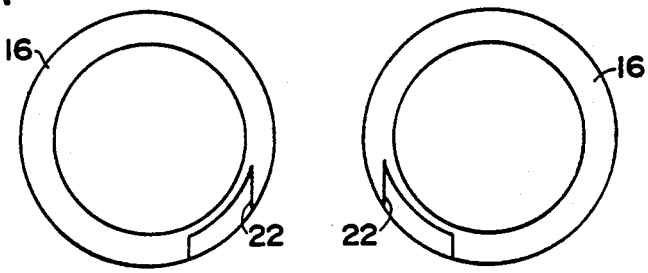

FIG. 4 shows a view of the valve elements.

The rotary compressor shown in the drawings is a screw compressor and comprises a housing 11 provided with two intersecting bores in which two rotors 12,13 are rotatable. Each rotor is provided with a number of lobes and intervening grooves. The rotors are provided with shafts 17 which are journalled in bearings 25. The rotors convey compressible fluid from an inlet opening 14 to an outlet opening 15 while compressing the fluid. A valve element 16 is longitudinally slidable in housing 11 along rotor shaft 17 which is provided with a sleeve 23 held in place by a nut 24. A valve element is provided for each rotor. A bushing 26 containing a number of seals 27 is arranged in housing 11. Valve element 16, provided with a seal 29, is movable between a first position 18, shown in FIG. 1*a*, in sealing cooperation with an end face 19 of rotor 13 and a second position 20, shown in FIG. 1*b*, creating a leakage path, illustrated by arrows 21, between outlet opening 15 and inlet opening 14 along the outer surface of the rotor. Valve element 16 is provided with a cut-out 22 so as not to unduly restrict the fluid flow at the outlet 15. The valve is also slidable along a pin 30 inserted in ring 26 so that valve 16 cannot turn in the housing 11. Valve element 16 is pushed toward second position 20 by the gas pressure at the outlet end of the compressor. In the illustrated embodiment of the invention valve element 16 is pushed toward first position 18 by gas pressure applied through channel 28. It is also possible to use hydraulic pressure or mechanical actuation of the valve element. The valve element can be positioned anywhere between the fully open position 20 and the closed position 18 by controlling the pressure of the gas supplied through channel 28 via chamber 31.

I claim:

1. A rotary compressor comprising a housing (11) provided with two intersecting bores, one rotor (12, 13) journalled for rotation in each of said bores for conveying compressible fluid from an inlet opening (14) to an outlet opening (15), each rotor comprising a number of lobes and intervening grooves, characterized by a valve element (16) slideable in said housing (11) along at least one rotor shaft (17) of at least one of said rotors between a first position (18) in sealing cooperation with an end face (19) of said at least one rotor and a second position (20) creating a leakage path (21) between the outlet opening (15) and the inlet opening (14) along the outer surface of said at least one rotor, said valve element (16) comprising an annular ring guided by a pin (30) being immobile relative to the housing (11).

2. A rotary compressor as claimed in claim 1, wherein said valve element (16) is partially disposed in said outlet opening and is provided with a cut-out (22) to reduce flow losses at the outlet opening (15) of the compressor.

3. A rotary compressor comprising a housing (11) provided with two intersecting bores, one rotor (12,13) journalled for rotation in each of said bores for conveying compressible fluid from an inlet opening (14) to an outlet opening (15), each rotor comprising a number of lobes and intervening grooves, characterized by a valve element (16) slidable in said housing (11) along a rotor shaft (17) of said rotors between a first position (18) in sealing cooperation with an end face (19) of said rotors and a second position (20) creating a leakage path (21) between the outlet opening (15) and the inlet opening (14) along the outer surface of the rotors, said valve element (16) comprising an annular ring guided by a pin (30) being immobile relative to the housing (11).

4. A rotary compressor comprising a housing (11) provided with two intersecting bores, one rotor (12,13) journalled for rotation in each of said bores for conveying compressible fluid from an inlet opening (14) to an outlet opening (15), each rotor comprising a number of lobes and intervening grooves, characterized by a valve element (16) slidable in said housing (11) along a rotor shaft (17) of said rotors between a first position (18) in sealing cooperation with an end face (19) of said rotors and a second position (20) creating a leakage path (21) between the outlet opening (15) and the inlet opening (14) along the outer surface of the rotors, said valve element (16) comprising an annular ring guided by a pin (30) being immobile relative to the housing (11), said valve element (16) being partially disposed in said outlet opening and being provided with a cut-out (22) to reduce flow losses at the outlet opening (15) of the compressor.

* * * * *